US006686053B2

(12) United States Patent
Wada et al.

(10) Patent No.: US 6,686,053 B2
(45) Date of Patent: Feb. 3, 2004

(54) AL ALLOY MEMBER HAVING EXCELLENT CORROSION RESISTANCE

(75) Inventors: Koji Wada, Kobe (JP); Jun Hisamoto, Kobe (JP)

(73) Assignee: Kabushiki Kaisha Kobe Seiko Sho, Kobe (JP)

( * ) Notice: Subject to any disclaimer, the term of this patent is extended or adjusted under 35 U.S.C. 154(b) by 0 days.

(21) Appl. No.: 10/196,198

(22) Filed: Jul. 17, 2002

(65) Prior Publication Data

US 2003/0035970 A1 Feb. 20, 2003

(30) Foreign Application Priority Data

Jul. 25, 2001 (JP) ..... 2001-224588

(51) Int. Cl.[7] ..... B32B 15/04
(52) U.S. Cl. ..... 428/472.2; 428/613; 428/701
(58) Field of Search ..... 428/472.2, 613, 428/701

(56) References Cited

U.S. PATENT DOCUMENTS

| | | | |
|---|---|---|---|
| 6,027,629 | A | 2/2000 | Hisamoto et al. |
| 6,066,392 | A | 5/2000 | Hisamoto et al. |
| 6,444,304 | B1 | 9/2002 | Hisamoto et al. |

FOREIGN PATENT DOCUMENTS

| | | |
|---|---|---|
| JP | 62-103377 | 5/1987 |
| JP | 3-072098 | 3/1991 |
| JP | 4-231485 | 8/1992 |
| JP | 5-114582 | 5/1993 |
| JP | 6-250383 | 9/1994 |
| JP | 7-207494 | 8/1995 |
| JP | 7-216589 | 8/1995 |
| JP | 8-144088 | 6/1996 |
| JP | 8-144089 | 6/1996 |
| JP | 8-193295 | 7/1996 |
| JP | 8-260088 | 10/1996 |
| JP | 8-260196 | 10/1996 |
| JP | 9-053196 | 2/1997 |
| JP | 9-217197 | 8/1997 |
| JP | 10-050663 | 2/1998 |
| JP | 11-001797 | 1/1999 |
| JP | 11-043734 | 2/1999 |
| JP | 11-140690 | 5/1999 |
| JP | 11-181595 | 7/1999 |
| JP | 11-229185 | 8/1999 |
| JP | 2001-220637 | 8/2001 |
| JP | 2001-335989 | 12/2001 |

*Primary Examiner*—Robert R. Koehler
(74) *Attorney, Agent, or Firm*—Oblon, Spivak, McClelland, Maier & Neustadt, P.C.

(57) ABSTRACT

An Al alloy member having excellent corrosion resistance comprises an Al or Al alloy substrate having an anodic oxide film including a porous layer and a pore-free barrier layer. At least a part of a structure of the barrier layer is altered into boehmite and/or pseudo-boehmite, a dissolution rate of the film is at 100 mg/dm$^2$/15 minutes or below when determined by an immersion test in phosphoric acid/chromic acid (JIS H 8683-2), and a corroded area percent is at 10% or below after allowing the film to stand in an atmosphere of 5% $Cl_2$—Ar gas at 400° C. for 4 hours.

4 Claims, 2 Drawing Sheets

AL ALLOY MEMBER HAVING EXCELLENT CORROSION RESISTANCE

BACKGROUND OF THE INVENTION

1. Field of the Invention

This invention relates to an improvement in gas corrosion resistance, plasma resistance and corrosive solution resistance of vacuum chamber members and anodized Al parts used in the inside thereof, which are employed for the manufacturing process of semiconductor and liquid crystal device by a dry etching apparatus, a CVD apparatus, a PVD apparatus, an ion implantation apparatus, a sputtering apparatus or the like. More particularly, the invention relates to an improvement in corrosive solution resistance of Al alloy members that are exposed to a corrosive solution such as an acidic solution.

2. Description of Related Art

Because of the introduction of a corrosive gas including a halogen element, such as Cl, F, Br or the like, into the vacuum chamber used for the CVD apparatus, the PVD apparatus, the dry etching apparatus or the like as a reactant gas, an etching gas, a cleaning gas or the like, a corrosion resistance to a corrosive gas (hereinafter referred to as gas corrosion resistance) is required therefor. In the vacuum chamber, a halogen-based plasma is frequently generated in addition to the corrosive gas, so that importance is placed on a resistance to plasma (hereinafter referred to as plasma resistance). In recent years, the vacuum chamber of Al or Al alloys that are light in weight and excellent in thermal conductivity has been recently adopted for this purpose.

However, since Al or Al alloys do not have enough gas corrosion resistance and plasma resistance for the process conditions, a variety of surface-modifying techniques of improving these resistance characteristics have been proposed.

For improving the gas corrosion and plasma resistances, some techniques are proposed. For example, JP-B No. 53870/1993 shows that after formation of an anodic oxide film having a thickness of 0.5 to 20 $\mu$m, heating and drying treatments are carried out in vacuum at 100 to 150° C. to remove the moisture adsorbed in the film by evaporation. Further, JP-A No. 72098/1991 shows that an Al alloy containing 0.05 to 4.0% of copper is subjected to anodization treatment in an oxalic acid electrolytic solution, followed by dropping a voltage in the electrolytic solution.

The chamber members using these Al alloys, obtained by application of these techniques, exhibit excellent gas corrosion and plasma resistances. Nevertheless, when the chamber member is subjected to maintenance by wiping out by means of water or by washing with water, the halogen compound remained on the surface of the Al or Al alloy parts react with water to form an acidic solution. The chamber member does not have an enough resistance to corrosion with such an acidic solution (hereinafter referred to as acidic solution resistance), so that it has been experienced that corrosion of the anodized oxide film takes place therein. The CVD apparatus, PVD apparatus or dry etching apparatus has such members that while mounting a semiconductor wafer or liquid crystal glass substrate, the member is subjected to the cleaning step of the wafer or substrate. For the cleaning in the cleaning step, an acidic solution is used. The corrosion of the anodic oxide film could not be restrained, in fact, through the surface modification made according to the prior-art techniques. If an Al alloy vacuum chamber member, used in the manufacturing process of semiconductor or liquid crystal device, suffers corrosion, its electric characteristics locally change, thus impeding the uniformity of treatment during the course of the semiconductor/liquid crystal device manufacturing process. In this way, the known Al alloy members have never been fully responsible for these applications requiring excellent electric characteristics. For a technique solving these problems. JP Patent No. 2831488 discloses the technique wherein an anodic oxide film is subjected to fluorination treatment. Moreover, JP-A No. 207494/1995 discloses a technique of sealing pores in an anodic oxide film with a metal salt. In addition, JP-A No. 216589/1995 proposes a technique wherein after sealing the pores in an anodic oxide film, a silicon-based film is further formed thereover. Although the acidic solution resistance is improved to some extent according to these techniques, the resultant member does not have satisfactory resistances including all of the gas corrosion resistance, plasma resistance and acidic solution resistance, and thus, limitation is placed on the environment of its use. Additionally, the complicated treating procedures are necessary, so that high fabrication costs are inevitably invited, thus being devoid of general-purpose properties.

SUMMARY OF THE INVENTION

An object of the invention is to provide an Al alloy member which overcomes the problems of the prior-art techniques.

Another object of the invention is to provide an Al alloy member which are excellent in gas corrosion resistance, plasma resistance and acidic solution resistance.

The above objects can be achieved, according to the invention, by an Al alloy member which comprises an Al or Al alloy substrate and an anodic oxide film formed on the substrate and including a porous layer and a pore-free barrier layer wherein at least a part of a structure of the barrier layer is made of boehmite and/or pseudo-boehmite, a dissolution rate of the film, subjected to an immersion test in phosphoric acid/chromic acid (described in JIS H8683-2), is 100 mg/dm$^2$/15 minutes or below, and a corroded area percent after allowing to be exposed to the condition of 5%$Cl_2$—Ar gas at 400° C. for 4 hours is 10% or below whereby the Al or Al member is excellent in corrosion resistances.

Preferably, the Al alloy should contain 0.1 to 2.0% (by weight herein and whenever it appears hereinafter) of Si, 0.1 to 3.5% of Mg, and 0.1 to 1.5% of Cu, or should contain 1.0 to 1.5% of Mn, 1.0 to 1.5% of Cu and 0.7 to 1.0% of Fe. The Al alloy member of the invention is conveniently used as a vacuum chamber member.

Other and further objects, features and advantages of the invention will appear more fully from the following description.

DETAILED DESCRIPTION OF THE PREFERRED EMBODIMENTS

As stated hereinabove, an anodized Al alloy member is poor in corrosion resistance to a corrosive solution, such as an acidic solution, formed upon maintenance through wiping out with use of water (i.e. corrosive solution resistance), and we have made intensive studies to improve the resistance. As a result, we have found that when it is determined as essential that at least a part of the structure of a barrier layer of an anodic oxide film consists of boehmite and/or pseudo-boehmite (which may be hereinafter referred to as "(pseudo) boehmite) and the degree of alteration of the anodic oxide film into (pseudo) boehmite and the state of the film (as to whether or not crack or film defect exist) are properly controlled, the reaction of a corrosive solution with an Al alloy substrate by infiltration through the anodic oxide film can be restrained where while excellent gas corrosion resistance and plasma resistance are maintained, the corrosive solution resistance can be improved.

Figure 1:
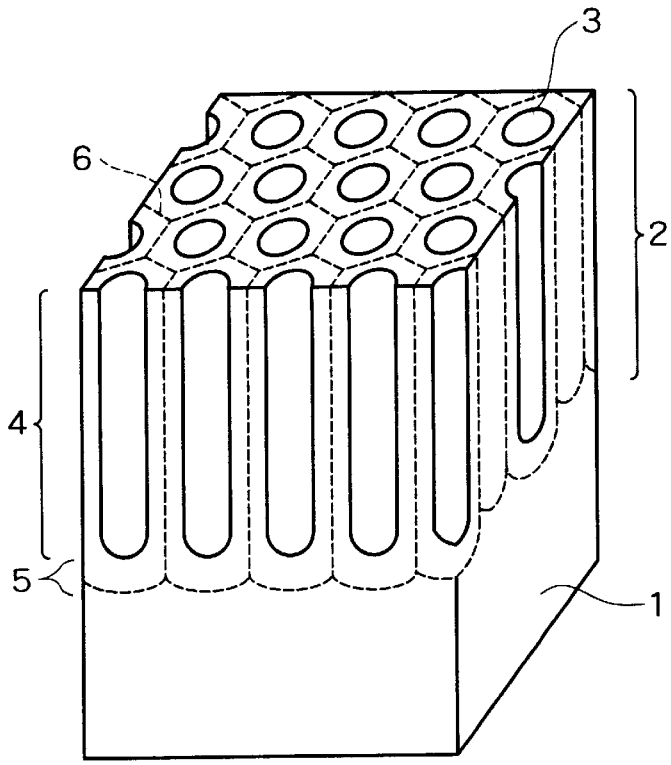
FIG. 1 is a sectional view conceptionally showing the rough structure of an anodic oxide film.

FIG. 1 is a sectional view conceptionally showing the schematic structure of the anodic oxide film formed on the surface of an anodized Al alloy member. In the figure, reference numeral 1 designates an Al substrate, and reference numeral 2 designates an anodic oxide film. Likewise, indicated by 3 is a pore, by 4 is a porous layer (i.e. a portion where the pores 3 are formed), by 5 is a barrier layer (i.e. a pore-free layer intervening between the porous layer 4 and the Al substrate 1) and by 6 is a cell.

In the practice of the invention, at least a part of the structure of the barrier layer should be altered into (pseudo) boehmite. With the case of an anodic oxide film including the porous layer having a multitude of pore opened at the film surface and the pore-free barrier layer as shown in FIG. 1, at least a part of the structure of the barrier layer 5 should be altered into (pseudo) boehmite wherein the pores may be opened or closed. In the invention, the alteration of the film (including at least a part of the barrier layer) into (pseudo) boehmite ensures excellent corrosion resistances. When the degree of alteration of the film into (pseudo) boehmite is such that the dissolution rate of the anodic oxide film determined by an immersion test in phosphoric acid/chromic acid (JIS H8683-2) is 100 mg/dm$^2$/15 minutes or below, and a corroded area percent after allowing to stand in an atmosphere of 5% $Cl_2$—Ar gas at 400° C. for 4 hours is 10% or below, the film is excellent against corrosion resistances (including gas corrosion resistance, plasma resistance and corrosion resistance to solution). Thus, the reaction of a corrosive solution with the Al alloy substrate after infiltration of the solution through the anodic oxide film can be restrained. That is, the alteration of at least a part of the barrier layer into (pseudo) boehmite ensures the good effect of suppressing the infiltration of a corrosive solution. It will be noted that as the barrier layer is altered into (pseudo) boehmite, the portion near the film surface (i.e. a portion of the porous portion other than the barrier layer) is altered into (pseudo) boehmite, which contributes to the control of infiltration of a corrosive solution through the film. In addition, the Al alloy substrate of the invention is not only excellent in corrosive solution resistance, but also excellent in gas corrosion resistance and plasma resistance. Preferred embodiments of a manufacturing method are set out to describe the invention in more detail, which should not be limited the invention thereto. Many modifications and variations of such embodiments may be possible without departing from the scope of the invention.

The Al or Al alloy used as a substrate in the present invention is not critically specified. It is desirable that the chemical composition of the Al substrate be properly prepared and the distribution (amount and size) of deposits and precipitates be properly controlled from the standpoint that Al-based substrate favorably has satisfactory mechanical strength, thermal conductivity and electric conductivity for used as an Al-based member, particularly, a chamber member and defects, such as crack, are controlled initially formed in the film by anodization. In view of this, a preferred chemical composition of the Al substrate includes an Al—Mn—Cu—Fe-based Al alloy, and an Al—Si—Mg—Cu-based Al alloy. A more preferred composition includes an Al alloy comprising 1.0 to 1.5% of Mn, 1.0 to 1.5% of Cu, 0.7 to 1.0% of Fe. Alternatively, an Al alloy comprising 0.1 to 2.0% of Si, 0.1 to 3.5% of Mg, and 0.1 to 1.5% of Cu is recommended as a more preferred one. When the content of alloy components increases, deposits and precipitates increase in amount. In this sense, it is preferred to appropriately control the contents of Si, Fe and Mg. The appropriate control of these components ensures the reduction in amount of deposits and precipitates and thus, permits the formation of a fine structure. It is to be noted that although the Al alloys containing such components as defined above are recommended in the practice of the invention, it is desirable that the balance in each case be substantially Al. The balance being substantially Al means to contain inevitable impurities (e.g., Cr, Zn, Ti and the like). Because inevitable impurities may contaminate a product to be processed (e.g., a semiconductor wafer or the like) after release from the film during use, it is recommended that the total content of these impurities is as small as possible and should preferably be 0.1% or below.

With the Al—Mn—Cu—Fe-based Al alloy, Mn and Fe, respectively, form compounds of $Al_6Mn$ and $Al_6$(Mn, Fe) that are thermally stable in the Al alloy matrix and have the effect of suppressing degradation (coarsening of crystal grains and precipitates) of mechanical properties, such as strength, due to the change in internal structure of the Al alloy undergoing thermal cycles. In order to obtain a satisfactory effect, it is preferred that Mn is present in an amount of 1.0% or over and Fe is present in an amount of 0.7% or over. If the content of Mn exceeds 1.5% or the content of Fe exceeds 1.0%, the corresponding compound is coarsened, the change of the internal structure of the Al alloy caused by the thermal cycles may be facilitates or corrosion resistances may be degraded.

Cu acts to make a smaller pore diameter at the side of the film surface and has the effect of restraining the film from being cracked. In order to show such an effect, the content of Cu should preferably be 1.0% or over. If the content of Cu exceeds 1.5%, the resultant compound undesirably becomes coarsened.

With the Al—Si—Mg—Cu-based Al alloy, Si and Mg are those elements which are effective in causing a $Mg_2Si$ precipitate to be formed by aging. To obtain an enough precipitation effect, it is preferred that the content of Si is 0.1% or over and the content of Mg is 0.1% or over. When the contents of Si and Mg, respectively, exceed 2.0% and 3.5%, coarse deposits and a coarse Si precipitation phase exemplified by $Mg_2Si$ and $Al_mMg$(such as $Al_3Mg_2$, $Al_{12}Mg_{17}$ and the like) are formed and are left in the anodic oxide film as defects, so that corrosion resistances may degrade.

When anodization is carried out in such a condition that Cu is concentrated around $Mg_2Si$, Cu acts to form spaces that are useful for mitigating a difference in coefficient of thermal expansion between cells in the anodic oxide film. To obtain such an action satisfactorily, the amount of Cu should preferably be 0.1% or over, more preferably 0.4% or over. If the content of Cu exceeds 1.5%, the growth of the film is impeded, thus leading to a prolonged anodization treatment time. This results in the inhomogeneity of the film surface, and a plasma resistance may degrade.

In the practice of the invention, various types of alloying elements may be appropriately added to Al depending on the intended purposes. In this connection, however, some types of elements may not be suited for the purpose in end use. For instance, where chromium or zinc is contained in an anodic oxide film, the element may be scattered after wastage of the film by the reaction of a plasma, thereby impeding the characteristics of a semiconductor or liquid crystal device.

Figure 2:
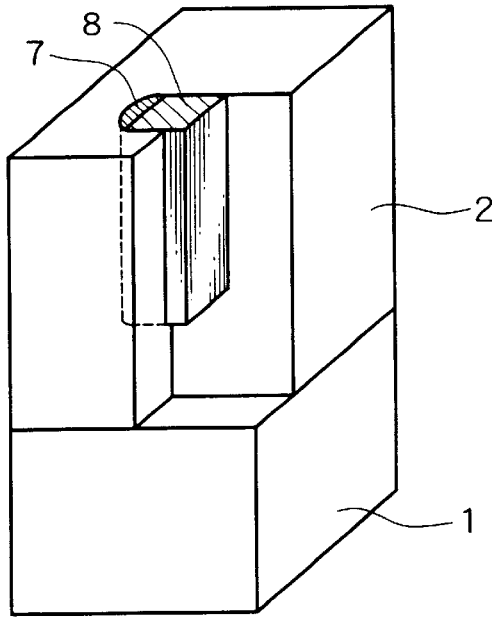
FIG. 2 is a sectional view conceptionally showing Si precipitates (in a vertical direction) and a space.
Figure 3:
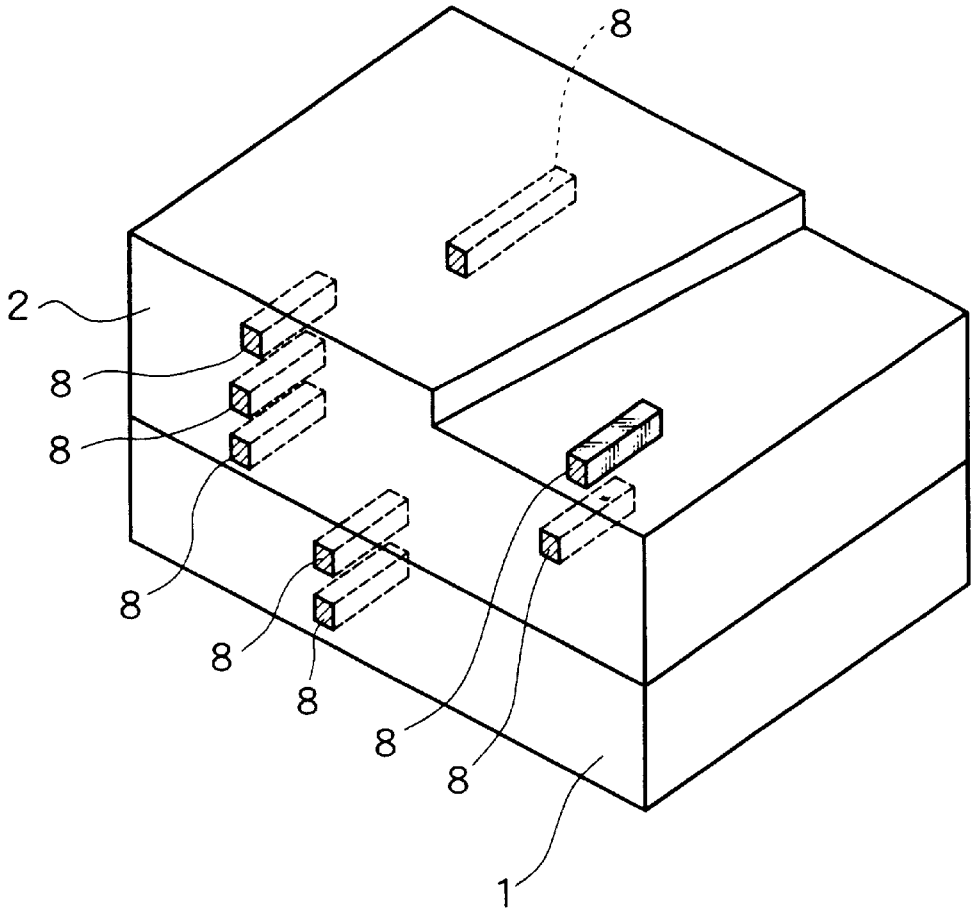
FIG. 3 is a schematic sectional view showing the state where Si precipitate are arranged substantially in parallel directions of orientation.

Deposits or precipitates may be contained in the Al substrate based on the origins of alloying elements and inevitable impurities. The terms "deposits" and "precipitates" mean solid matters left in a substrate matrix (Al) without formation of solid solution. For instance, a larger amount of Si is more unlikely to convert Si into solid solution in the matrix with an increasing amount of residual Si. This residual Si could be appeared as the deposit or precipitate. In this way, the deposits or precipitates left in the Al substrate could not solutionize upon anodization treatment and may be left in the resultant anodic oxide film. When deposits or precipitates exist in the anodic oxide film, a corrosive solution may infiltrate via the interface between the deposits or precipitates and the film matrix, thereby adversely influencing the corrosive solution resistancee. As shown in FIG. 2, for example where Si precipitates (or deposits) in the anodic oxide film formed by anodization treatment, a space 7 exists between precipitated Si 8 and an anodic oxide film matrix 2, through which a corrosive solution infiltrates to cause the Al alloy substrate to be corroded, thereby not showing a satisfactory corrosive solution resistance. Moreover, the anodic oxide film is to crack from the starting point of the space. From the standpoint of an improvement in corrosive solution resistance and film strength, it is preferred that the deposits or precipitates are as small in number as possible. If these deposits or precipitates exist, a smaller average size results in a smaller space capacity and a smaller amount of a corrosive solution being infiltrated in case where they are left in the anodic oxide film. In addition, when the deposits or precipitates (along the length thereof) in the substrate are so arranged, as shown in FIG. 3, that they are substantially in parallel to a face having a maximum area of the substrate, the deposits or precipitates become similarly arranged in the parallel directions in an anodic oxide film to be formed. Thus, the amount of the corrosive solution infiltrated along the depth (or along a direction of thickness) is reduced, thus being effective in improving the corrosive solution resistance. If precipitates or the like is arranged in the parallel directions, film cracking is more unlikely to occur than in the case where they are arranged in vertical directions.

Accordingly, if deposits or precipitates exist in the Al substrate finely and in a condition of parallel arrangement, the deposits or precipitates that are left in a subsequently formed anodic oxide film remain in the film as being fine and in a condition of parallel arrangement. Thus, the space between adjacent deposits or precipitates existing along the direction of infiltration of the corrosive solution (on a vertical line at the same depth) can be properly kept. In this manner, the state where the deposits or precipitates contiguously exist (i.e. a frozen-in state) can be inhibited. As a result, the corrosive solution which is to be infiltrated through the interface between the deposits or precipitates and the matrix (Al) can be effectively impeded.

In order to attain such an effect as set out above, the size along a direction intersecting at right angles relative to the length or major axis in average of the deposits and precipitates should preferably be 10 $\mu$m or below on average. In particular, with deposits, the size should more preferably be 6 $\mu$m or below and most preferably 3 $\mu$m or below. With precipitates, the size should more preferably be 2 $\mu$m or below and most preferably 1 $\mu$m or below. If this is satisfied as average size, too large a maximum size along a direction intersecting at right angles with the length of the deposits and precipitates may not lead to satisfactory corrosive solution resistance and film cracking resistance. Accordingly, the maximum size of the deposits and precipitates should preferably be 15 $\mu$m or below, more preferably 10 $\mu$m or below.

It will be noted that the term "average size" is intended to mean the value obtained by dividing, by the total number of the deposits and precipitates, the total of maximum diameters (i.e. a diameter along a direction intersecting at right angles with the length) of individual deposits and precipitates at the cut face cut vertically relative to a member surface having a maximum area among the surfaces of the Al member, i.e. the cut face including those of the Al substrate and the anodic oxide film. The average size can be measured by observing the cut face through an optical microscope.

The uniform dispersion of the deposits and precipitates is preferred from the standpoint that the local degradation of the film is suppressed owing to the uneven distribution of the deposits and precipitates. It will be noted that although the manner of making very fine sizes of deposits and precipitates and uniformly dispersing them in an Al substrate is not critical, the fineness and uniformity can be achieved, for example, by controlling a casting speed in the casting stage of an Al substrate. In other words, when the cooling speed is as high as possible at the casting stage, the size of the deposits and precipitates can be made small. More particularly, the cooling speed at the casting stage should preferably be 1° C./second or over, more preferably 10° C./second or over. Moreover, it is possible to control the size and shape and the dispersion state of precipitates as preferred ones by thermal treatments (e.g., T4, T6) being carried out finally. For instance, it is effective for this purpose that a liquefying treatment temperature is set at a level as high as possible (e.g., increased to the vicinity of a solid high temperature) to form an oversaturated solid solution, after which a multistage aging treatment such as two-stage or three-stage aging, is effected. In this manner, if the thermal treatment is performed under control even after casting, the size of precipitates can be controlled as being smaller and the precipitates can be uniformly dispersed in the substrate matrix. The deposits or precipitates are liable to be arranged along the direction of extrusion or rolling, so that they can be arranged in parallel to one another by controlling the direction of extrusion or rolling during hot extrusion or hot rolling after casting.

The invention is characterized in the state of an anodic oxide film and is not critical with respect to the conditions of forming the anodic oxide film. Nevertheless, if defects such as crack, peeling-off, void and the like exist in the anodic oxide film, a corrosive solution infiltrates through the defects, thus not obtaining an enough corrosive solution resistance. Accordingly, it is recommended to carry out such an anodization treatment as set forth below using an Al substrate of the type set out hereinbefore, so that crack or the like defect-free anodic oxide film ($Al_2O_3$) can be readily obtained.

The electrolytic solution used for the anodization includes an inorganic acid solution such as a sulfuric acid solution, a phosphoric acid solution, a chromic acid solution, a boric acid solution or the like, or an organic acid solution such as a formic acid solution, an oxalic acid solution or the like. Of these, it is preferred to use an electrolytic solution that has small dissolution powder for the anodic oxide film. In particular, the use of an oxalic acid solution is preferred because the control of anodizing conditions (such as an electrolytic voltage and the like) becomes easy and it is easy to form a film that is free of defects such as cracks and the like and has excellent properties such as a crack resistance. Although an organic acid solution, such as a malonic acid solution, a tartaric acid solution or the like, which exhibits small dissolution for an anodic oxide film, may be used, the rate of an anodic oxide film-growing is not so high that if these solutions are used, it is preferred to add oxalic acid in an appropriate amount in order to promote the rate of film-growing. It will be noted that the concentration of a liquid electrolyte component such as an organic acid in the electrolytic solution is not critical, the concentration should be appropriately controlled within such a range that the satisfied rate of anodic oxide film-growing is obtained and defects, such as pitting, are not formed in the resultant film. For instance, where an oxalic acid solution is used, the satisfied rate of film-growing may not be obtained at a low concentration of oxalic acid. To avoid this, the concentration of oxalic acid should preferably be 2% or over. Nevertheless, if the concentration of oxalic acid becomes too high, pitting may be formed in the film, so that the upper limit of the concentration recommended is at 5%.

It is to be noted that because the anodic oxide film formed by use of a sulfuric acid solution is liable to crack, the use of a sulfuric acid solution needs a more precise control of anodizing condition such as an electrolytic voltage when compared with the case using an oxalic acid solution.

The anodic oxide film formed by means of a chromic acid solution has a crack resistance. Because chromium is inevitably contained in the film during the step of the film formation, the characteristics of a semiconductor or liquid crystal device may be impeded with the chromium. Accordingly, where the film is used in the manufacturing process of a semiconductor or liquid crystal device, it is necessary to select the constituent composition of an aluminium substrate, control the anodizing condition (including treating solution temperature, electrolytic conditions and treating time), and control the concentration of chromic acid, depending on required characteristics. As will be seen from the above, the use of a chromic acid solution places a more severe limitation on the environment of its use that the use of an oxalic acid solution, with more complicated anodizing conditions.

Furthermore, the anodic oxide film formed by use of a phosphoric acid solution exhibits a crack resistance. Phosphorus is contained during the film-forming step, so that the hydration reaction is impeded by the action of the phosphorus and thus, it takes a long time before alteration of the barrier layer into (pseudo) boehmite. Thus, a production efficiency is lower than in the case using an oxalic acid solution.

The boric acid solution has too small rate of dissolution of Al, for which in order to form an anodic oxide film having a thickness (1 $\mu$m) sufficient to ensure a satisfactory plasma resistance, more complicated treatments are necessary in comparison with the case using an oxalic acid solution.

The temperature of an electrolytic solution used upon the anodization is not significant, however, the temperature is too low, an enough rate of film-forming cannot be obtained, and thus, an efficiency of anodized film-forming may be lowered. In contrast, if the bath temperature is too high, the film is dissolved as too high rate in the solution, so that defects could be formed in the film, with the result that a desired anodic oxide film may not be formed as a possible result. For instance, where an oxalic acid solution is used, the bath temperature should preferably be 15° C. or over, and should also be preferred at 40° C. or below, more preferably 35° C. or below.

The electrolytic voltage during the anodization should be appropriately controlled depending on the rate of film-growing and the concentration of an electrolytic solution. For example, where an oxalic acid is employed, an appropriate rate of film-growing is not obtained at a low electrolytic voltage, with a poor anodization efficiency. If the voltage is too high, the film is apt to be dissolved and defects may be formed in the film. Thus, it is recommended that the voltage preferably ranges 10V to 120V. The anodization time should be determined while taking into consideration a time for which a desired film thickness is obtainable.

It will be noted that the thickness of the anodic oxide film formed by the anodization is not particularly limited. In order to show gas corrosion resistance, plasma resistance and corrosive solution resistance, the thickness is preferably 1 $\mu$m or over, more preferably 5 $\mu$m or over, and most preferably 10 $\mu$m or over. If the film thickness is too large, film cracking could occur by the influence of internal stress and film separation is also apt to occur. Accordingly, the thickness is preferably 100 $\mu$m or below, more preferably 80 $\mu$m or below and most preferably 50 $\mu$m or below.

In the practice of the invention, it is recommended that the film obtained after anodization treatment is subjected to hydration and altered into (pseudo) boehmite. It should be noted that the pore diameter is changed according to the hydration treatment, and the pore diameter (i.e. a pore diameter in the film surface) formed in the film after the anodization is not critical.

The barrier layer plays an important role as preventing the contact between the corrosive solution entering into the pores and the Al alloy substrate. Usually, a long-time exposure to a corrosive solution permits the corrosive solution to be gradually penetrated into the barrier layer, and thus, the Al or Al alloy substrate might be corroded with time. In this sense, a thicker barrier layer is more preferred. In order to form a thick barrier layer, the pore diameter has to be made large. As the pore diameter increases, plasma resistance lowers and a corrosive gas or a corrosive solution is more liable to enter into the pores, so that film characteristics as a resistant layer cannot be maintained. More particularly, even if the pore diameter formed in the film by the anodization and the barrier layer thickness are, respectively, controlled appropriately so as to ensure a pore size within a certain range and a barrier layer thickness within a certain range and show corrosive solution resistance, plasma resistance and gas corrosion resistance, such a film does not necessarily have the resistances required for the respective characteristics when applied to as the vacuum chamber member used in the manufacturing process of semiconductor or liquid crystal device. In addition, complicated anodizing operations have to be conducted, resulting in an increase in manufacturing costs.

According to the invention, however, at least part of the structure of the barrier layer is altered into (pseudo) boehmite, and thus, excellent corrosive solution resistance is shown (i.e. the excellent effect of restraining the corrosive solution from entering and penetrating into the barrier layer is shown). In view of this, it is not necessary to form the barrier layer as thick as a conventional one. Thus, according to the invention, a thin barrier layer is sufficient to obtain excellent corrosion resistances to all of a plasma, corrosive gas and corrosive solution. In the invention, the thickness of the barrier layer is not specified and should depend on the required characteristics such as corrosive solution resistance. Moreover, it is not necessary in the practice of the invention to alter all the barrier layer into (pseudo) boehmite. More particularly, the barrier layer altered into (pseudo) boehmite exhibits more excellent corrosive solution resistance than conventional barrier layer. So far as a required corrosive solution resistance is imparted to, it is not always necessary that the barrier layer be wholly altered into (pseudo) boehmite, and the barrier layer altered into (pseudo) boehmite is not critical with respect to the thickness thereof. It will be noted that the alteration to at least a part of the barrier layer means that the alteration of it into (pseudo) boehmite proceeds over a porous layer other than the (pseudo) boehmite portion of the barrier layer, i.e. a portion ranging from a film surface to the just-mentioned (pseudo) boehmite. In particular, since the film surface portion is also altered into (pseudo) boehmite, it exhibits a more excellent corrosion resistances than the film portion not altered into (pseudo) boehmite.

The anodic oxide film having such a corrosive solution resistance as required by the invention and altered into (pseudo) boehmite should preferably be one wherein at least a part of the structure of the barrier layer is altered into (pseudo) boehmite, the dissolution rate of the anodic oxide film, determined according to an immersion test in phosphoric acid/chromic acid (JIS H8683-$2^{1999}$) is 100 mg/dm$^2$/15 minutes or below, more preferably 20 mg/dm$^2$/15 minutes or below and most preferably 100 mg/dm$^2$/15 minutes or below. Accordingly, when at least a part of the barrier layer is altered into (pseudo) boehmite and the dissolution rate is 100 mg/dm$^2$/15 minutes or below, it is meant that the film is altered into (pseudo) boehmite to such an extent necessary for a required corrosive solution resistance. A satisfactory corrosive solution resistance cannot be expected if the barrier layer is altered into (pseudo) boehmite but the dissolution rate exceeds 100 mg/dm$^2$/15 minutes or if the dissolution rate is below 100 mg/dm$^2$/15 minutes but the barrier layer is not altered into (pseudo) boehmite.

It will be noted that the anodic oxide film having an excellent corrosive solution resistance, i.e. the film altered into (pseudo) boehmite. Can be obtained by subjecting to hydration treatment as described hereinafter. The volume of the anodic oxide film is expanded by hydration, so that if the reaction of the film to (pseudo) boehmite is facilitated excessively, the film suffers cracking owing to the volumetric expansion. If the film is cracked, a corrosive solution infiltrates via the cracks, and thus, a corrosive solution resistance cannot be obtained if the rate of reaction (alteration) of the barrier layer into (pseudo) boehmite is increased. Moreover, if the film has defects other than cracks, pittings ascribed to the deposits or precipitates of an aluminium substrate or ascribed to the inappropriate setting of anodizing conditions, a corrosive solution will infiltrate through the defects. In the practice of the invention, the requirement for the immersion test in phosphoric acid/chromic acid should be satisfied and the film should be free of defect such as crack. Where cracks or defects exist in the film, a corrosive solution infiltrates through the cracks or defects to cause the substrate to be corroded, and characteristics are greatly influenced even through the corrosion occurs only locally. Accordingly, it is desirable that such crack or defect does not exist. It will be noted that the presence or absence of crack or defect in the film is not reflected when the film is subjected to the immersion test in phosphoric acid/chromic acid and that it is difficult to find out local crack or defect by observation through an optical microscope or electron microscope. Under these circumstances, intensive studies have been made on the corroded area percent determined by a gas corrosion test (wherein the film is allowed to stand at 400 C. in an atmosphere of 5% $Cl_2$—Ar gas) for use as an index for cracks or defects in a film. As a result, it has been found that the corrosive solution resistance is good enough when the corroded area percent is preferably 10% or below, more preferably 1% or below. Accordingly, in the practice of the invention, at least a part of the barrier layer should be altered into (pseudo) boehmite to such an extent that such results are set out above are obtained in the immersion test in phosphoric acid/chromic acid and also in the gas corrosion test.

The term "boehmite and pseudo-boehmite" used herein is intended to mean hydrated alumina represented by the general formula, $Al_2O_3.nH_2O$. In particular, n is 1 to 1.9 in the above general formula. Whether or not the barrier layer is altered into (pseudo) boehmite is determined by analyzing a barrier layer portion by use of X-ray diffraction, X-ray photoelectron spectroscopy (XPS), Fourier transformation infrared absorption spectroscopy (FT-IR), SEM or the like. For instance, the section of an anodic oxide film used as a test piece is observed through SEM to determine the position of a barrier layer from an Al substrate (i.e. a barrier layer thickness). Thereafter, the anodic oxide film is subjected to X-ray diffraction analysis and X-ray photoelectron spectroscopy (XPS) in combination to discriminate and quantitatively analyze, along the thickness (or the depth of the film), the existence of (pseudo) boehmite in the portion of the barrier layer from the intensities of X-ray diffraction peaks of Al—O, Al—OH and Al—O—OH that constitute the structure of the original anodic oxide film. Whether or not at least a part of the barrier layer is altered into (pseudo) boehmite can be confirmed according to the above procedure.

For the alteration of an anodic oxide film into (pseudo) boehmite, the anodic oxide film (made of aluminium oxide) formed by anodization of an Al substrate is subjected to hydration (i.e. a sealing treatment wherein the anodic oxide film is brought into contact with hot water). The film that is hydrated so as to satisfy the above requirement and altered into (pseudo) boehmite exhibits excellent corrosion resistances. For the hydration, conditions used upon the hydration should be appropriately set so that the above requirement is satisfied. The hydration may be carried out, for example, by a hydration method wherein an anodic oxide film is immersed in water (immersion in water) or by a hydration method wherein the film is exposed to steam. With the hydration method using the exposure to steam, when steam is pressurized to a level higher than a normal pressure, its temperature can be as high as 100° C. or over, under which the pressure, temperature and hydration time are appropriately controlled. It should be noted that when using this hydration method, hydration commences to proceed from the surface of an anodic oxide film, for which volumetric expansion takes place from the surface of the film according to the hydration and precise control of pressure, temperature and hydration time is necessary. More particularly, the pores in the film surface are made smaller in size by the influence of the film expansion of the surface, so that steam is prevented from entering into the pores, and thus, the alteration of the barrier layer into (pseudo) boehmite does not proceed adequately. In addition, the volume expansion of the film in the surface proceeds in excess, cracks are developed. Accordingly, it is necessary that the alteration of the barrier layer into (pseudo) boehmite proceed appropriately and that pressure, temperature and hydration time be controlled so as not to cause cracks in the film. If the hydration time is too short, the barrier layer cannot be reacted to (pseudo) boehmite. Too long a treating time results in the film being cracked, so that corrosive solution resistance cannot be obtained. A higher pressure is more liable to cause steam to arrive at the barrier layer but permits hydration in the film surface to proceed more quickly. A high temperature causes alteration of the barrier layer into (pseudo) boehmite to proceed more quickly, but also causes the hydration in the film surface to proceed more quickly. In particular, the optimum ranges of pressure and temperature vary depending on the pore size in the film, film thickness and hydration time. As will be apparent from the above, with the hydration using exposure to steam, precise control is necessary. In the practice of the invention, it is recommended to use a hydration using immersion in water.

As a solution used for hydration by immersion in water, it is preferred to use pure water. As a matter of course, additives may be appropriately added to depending on the purpose. The use of additives may undesirably lead to the higher cost of a treating solution, and the more complicated control of the treating solution. Moreover, if an additive substance is taken in pores, the characteristics of semiconductor or liquid crystal device may be impeded by means of the substance. Accordingly, if additives are added to the treating solution, the content of the additives should preferably be specified. For instance, where nickel acetate is added, the content of nickel acetate in a treating solution after the addition of the additive is preferably smaller than 5 g/liter, more preferably smaller than 1 g/liter. Likewise, with cobalt acetate, the content of cobalt acetate is preferably smaller than 5 g/liter, more preferably smaller than 1 g/liter. With potassium bichromate, the content of potassium bichromate is preferably smaller than 10 g/liter, more preferably smaller than 5 g/liter. With sodium carbonate, the content of sodium carbonate is preferably smaller than 5 g/liter, more preferably smaller than 1 g/liter. With sodium silicate, the content of sodium silicate is preferably smaller than 5 g/liter, more preferably smaller than 1 g/liter. While a higher hot water-treating temperature results in a shorter optimum treating time, an optimum range of the treating time becomes narrow, thus requiring precise control. Accordingly, the treating temperature should be preferably selected so as to ensure a treating time that is good for workability. On the other hand, a lower treating temperature leads to a more prolonged treating time. A preferred temperature is at 70° C. or over. The hydration time should be appropriately controlled depending on the temperature and the degree in progress of hydration. Nevertheless, a short hydration time may not result in the satisfactory conversion of the film into (pseudo) boehmite. On the other hand, too long a treating time may cause the film to be cracked, resulting if the degradation of corrosive solution resistance.

When such hydration as set out above is carried out, a portion covering from the film surface to the barrier layer is altered into (pseudo) boehmite to an extent desired requirements, and the anodic oxide film is favorably improved in quality, with film defects being not involved therein, thus showing excellent corrosion resistances.

It will be noted that the film surface after the hydration is not critical with respect to the presence or absence of pores therein. More particularly, the pores may be sealed by the hydration or may be left opened. moreover, the pore size or the shape of pores in the film is not specified.

The invention is described in more detail by way of examples, which should not be construed as limiting the invention thereto. Many variations may be possible without departing from the spirit of the invention.

EXAMPLES

Al specimens having compositions indicated in Table 1 were, respectively, cut out into 50 mm square and polished with abrasive paper (#400). Thereafter, each specimen was pretreated by immersion in a 10% NaOH solution (bath temperature =50° C.) for 15 second for alkali defatting and further by immersion in a 20% $HNO_2$ solution (bath temperature=room temperature) for 5 minutes for desmutting (i.e. removing residual smutt). The resulting Al specimens were, respectively, anodized to form an anodic oxide film on each substrate, followed by hydration (see Tables 2 and 3) to obtain individual coupons. These coupons were checked with respect to the corrosive solution resistance thereof.

Anodization Treatment

Each of solutions (10 liters) indicated in Tables 2 and 3 was placed in a container and heated from outside under control with a temperature controller. Such a voltage as indicated in Tables 2 and 3 was applied between a platinum counter electrode and each Al substrate test piece, followed by continuing the voltage application until an anodic oxide film was formed in a desired thickness. Subsequently, the respective test pieces were washed with water.

Hydration Treatment

Treatment with water: a container having water (2 liters) therein was controlled in temperature by means of a temperature controller, and each specimen was placed in the water for a given time, followed by washing with water and drying.

Treatment with pressurized steam: a specimen was charged into an autoclave and exposed to steam under given conditions (including pressure and time) for a given time, followed by washing with water and drying.

Immersion Test in Phosphoric Acid/chromic Acid

Based on the method described in JIS H 8683-2$^{1999}$, the film was immersed in a phosphoric acid-chromic acid aqueous solution to measure a weight loss to check a dissolution rate (mg/dm$^2$/15 minutes). As described in JIS H 8683-2$^{1999}$, the specimen was immersed in a nitric acid solution (500 ml/liter, 18 to 20° C.) for 10 minutes, after which the specimen was removed and washed with deionized water and dried with hot air, followed by measurement of the weight thereof. Thereafter, the respective specimens were immersed in a phosphoric acid-chromic anhydride solution (i.e. a solution of 35 ml of phosphoric acid and 20 g of chromic anhydride in 1 liter of deionized water), kept at 38±1° C., for 15 minutes. The specimen was removed, and was washed in a water vessel, further washed well in running water and still further washed well in deionized water, followed by drying with hot air and measuring the weight thereof, from which a weight loss per unit area was calculated. Where the film is altered into (pseudo) boehmite, a smaller dissolution rate indicates a higher degree of modification of the film. The results of the dissolution rate of the anodic oxide films are shown in Tables 2 and 3. It will be noted that the unit at the column of the phosphoric acid/chromic acid test is mg/dm$^2$/15 minutes.

Chlorine Gas Corrosion Test

The surface of the anodic oxide film that was used for a chlorine gas corrosion test was cleansed by wiping with the soft cloth wetted with acetone, depending on the degree of smears. Thereafter, the film surface of the specimen was masked with a chlorine gas-resistant tape (polyimide tape) to permit a surface portion to be exposed by 20 $mm^2$ as a test area. Heaters were in the testing container (quartz tube), which was resistant to chlorine gas, so as to surround a test container therewith and uniformly heat the inside of the container. Moreover, this evaluation apparatus was with a thermocouple inside the testing chamber for the measurement and control of temperature. Specimens to be evaluated were placed in the testing container apparatus (at room temperature) and heated. The heating conditions were such that after charging the specimens into the testing apparatus, the temperature was raised to 145 to 155° C. in 20 to 30 minutes, followed by keeping at the temperature (145 to 155° C.) for 60 minutes. Subsequently, while a 5% (±0.2%) $Cl_2$—Ar gas was fed at a flow rate of 130 ccm, the content of the testing container was simultaneously heated to 395 to 405° C. in 20 to 35 minutes, followed by keeping at that time. It will be noted that the pressure in the test container was set at the atmospheric pressure. The feed of the $Cl_2$—Ar gas was continued over 4 hours. The feed of the $Cl_2$—Ar gas was stopped and the $Cl_2$—Ar gas left in the system was discharged by the action of the residual pressure, followed by feed of nitrogen gas. Simultaneously with the stop of the $Cl_2$—Ar gas feed, heating was stopped, followed by allowing to cool down to room temperature (for which it took 3 to 4 hours). At room temperature at the inside of the testing container, the feed of the nitrogen gas was stopped and the test piece was removed, followed by calculation of a corroded area percent (corroded area/test area) on the test surface. A higher corroded area percent indicates a greater number of cracks in the anodic oxide film and film defects, and a lower area ratio indicates a film having a lesser number of cracks and film defects. It is to be noted that corrosion is regarded as being developed when the anodic oxide film on the film surface disappears. At the portion of disappearance of the film, the Al substrate suffered corrosion and discoloration. The corroded area percent is indicted in Tables 2 and 3.

Alteration of barrier layer into boehmite and/or pseudo-boehmite

The alteration of the barrier layer into (pseudo) boehmite was investigated by discrimination from and quantitative analysis of Al—O, Al—OH and Al—O—OH structures of the original anodic oxide film by using X-ray diffraction and X-ray photoelectron spectroscopy (XPS). More particularly, the section of the anodic oxide film of a specimens was observed through SEM of 20,000 to 100,000 magnifications to determine the position of a barrier layer from an Al substrate (i.e. the thickness of the barrier layer). The quantitative analysis was performed along the thickness (depth) to confirm whether or not (pseudo) boehmite existed in the barrier layer portion. The reaction of the barrier layer into (pseudo) boehmite was also measured by discrimination from the Al—O, Al—OH and Al—O—OH structures of an original anodic oxide film by using X-ray diffraction and X-ray photoelectron spectroscopy (XPS) in combination as mentioned above. The results are shown in Tables 2 and 3. It will be noted that the symbols "○" and "X", respectively, indicate "yes" and "no" as to the alteration of at least a part of a barrier layer portion into (pseudo) boehmite.

Immersion Test in Hydrochloric Acid

The surface of an anodic oxide film to be used for an immersion test in hydrochloric acid was cleansed by wiping with soft cloth wetted with acetone, depending on the degree of smears. Next, a test piece was set in an oven heated to 150° C. Although the temperature in the oven was dropped to 145° C. by opening and closing the door of the oven upon the setting of the specimen, the temperature was returned to 150° C. in about 10 minutes. The specimen was kept for 1 hour after the temperature in the oven arrived at 150° C., after which the heating was stopped, followed by allowing to cool down to room temperature (in about 1 hour) and removing the specimen from the oven. The test surface of the specimen was masked with a hydrochloric acid-resistant tape (fluorine resin tape) so that area to be exposed was at 40 $mm^2$. A transparent container resistant to hydrochloric acid was provided as a testing apparatus. The immersion test of the specimen was conducted as follows. The specimen was so set in the test container that the test surface was turned upward, and a 7% hydrochloric acid solution was charged into the container until the distance from the surface to be examined to the surface of the hydrochloric acid solution was 40 mm. It will be noted that the hydrochloric acid solution per 40 $mm^2$ was amounted to 150 cc. The test container was not heated and the test was conducted at room temperature. The time before the continuous generation of a gas from the exposed surface (i.e. a time after the commencement of charge of the 7% hydrochloric acid solution) was taken as a hydrogen generation-commencing time. The gas generating from the surface of the specimen was such that $2Al+6HCl \rightarrow 2AlCl_3+3H_2\uparrow$ A long time before the generation of the gas means a better corrosive solution resistance. The results are shown in tables 2 amd 3. In particular, specimen showing a hydrogen generation time of 300 minutes or over has corrosive solution resistance, and specimen of 350 minutes or over is more preferred, specimen of 400 minutes or over is much more preferred, and specimen of 450 minutes or over is most preferred with respect to the corrosive solution resistance.

TABLE 1

| Symbol | Si | Mg | Cu | Fe | Mn | Arrangement | Grain size |
|---|---|---|---|---|---|---|---|
| K01 | 1.0 | 2.0 | 1.0 | — | — | parallel | 5 |
| K02 | 1.0 | 2.0 | 1.0 | — | — | vertical | 8 |
| A01 | 0.1 | 0.2 | 1.4 | — | — | parallel | 6 |
| A02 | 0.2 | 3.2 | 0.1 | — | — | parallel | 8 |
| A03 | 0.4 | 0.1 | 0.4 | — | — | parallel | 2 |
| A04 | 0.6 | 3.0 | 1.5 | — | — | parallel | 4 |
| A05 | 2.0 | 0.3 | 1.2 | — | — | parallel | 7 |
| A06 | 1.8 | 2.7 | 0.3 | — | — | parallel | 2 |
| A07 | 1.9 | 0.3 | 0.7 | — | — | parallel | 6 |
| A08 | 1.7 | 3.5 | 1.3 | — | — | parallel | 4 |
| A09 | 1.0 | 2.0 | 1.7 | — | — | parallel | 12 |
| A10 | 1.0 | 2.0 | 0.08 | — | — | parallel | 8 |
| A11 | 1.0 | 3.7 | 1.0 | — | — | parallel | 6 |
| A12 | 1.0 | 0.08 | 1.0 | — | — | parallel | 2 |
| A13 | 2.2 | 2.0 | 1.0 | — | — | parallel | 4 |
| A14 | 0.08 | 2.0 | 1.0 | — | — | parallel | 8 |
| B01 | — | — | 1.0 | 0.7 | 1.2 | parallel | 7 |
| B02 | — | — | 1.2 | 0.8 | 1.0 | parallel | 2 |
| B03 | — | — | 1.1 | 0.9 | 1.5 | parallel | 6 |
| B04 | — | — | 1.5 | 1.0 | 1.3 | parallel | 8 |
| B05 | — | — | 0.8 | 0.8 | 1.2 | parallel | 7 |
| B06 | — | — | 1.6 | 0.8 | 1.2 | parallel | 11 |
| B07 | — | — | 1.3 | 0.5 | 1.2 | parallel | 6 |
| B08 | — | — | 1.3 | 1.2 | 1.2 | parallel | 12 |
| B09 | — | — | 1.3 | 0.8 | 0.9 | parallel | 3 |
| B10 | — | — | 1.3 | 0.8 | 1.7 | parallel | 13 |

*The values of the components (Si, Mg, Cu, Fe and Mn) are by wt %.
*The term "arrangement" in the table means the state of arrangement of precipitates and crystal deposits relative to the maximum area of a substrate wherein the term "parallel" means such a state as shown in FIG. 5 and the term "vertical" means such a state as shown in FIG. 4.
*The term "grain-size" in the table means an average size (μm) of precipitates and crystal deposits in a direction intersecting at right angles with the lengthwise direction.

TABLE 2

| No. | Substrate | Anodization treatment: Electrolytic solution | Treating temperature (° C.) | Electrolytic conditions (V) | Film thickness (μm) | Hydration treatment: Manner of hydration | Hydration temperature (° C.) | Hydration time (minutes) |
|---|---|---|---|---|---|---|---|---|
| 1 | K01 | 4% oxalic acid | 18 | 30 | 40 | Immersion | 70 | 25 |
| 2 | | | | | | in hot water | 100 | 9 |
| 3 | | 3% oxalic acid | 20 | 75 | 23 | | 78 | 22 |
| 4 | | 4% oxalic acid | 18 | 30 | 40 | | 70 | 22 |
| 5 | | | | | | | 70 | 28 |
| 6 | | | | | | | 100 | 8 |
| 7 | | | | | | | 100 | 10 |
| 8 | | 2.5% oxalic acid | 30 | 60 | 32 | | 92 | 15 |
| 9 | | 4% oxalic acid | 18 | 30 | 40 | | 70 | 20 |
| 10 | | | | | | | 70 | 35 |
| 11 | | | | | | | 100 | 7 |
| 12 | | | | | | | 100 | 14 |
| 13 | | 4.5% oxalic acid | 25 | 50 | 12 | | 85 | 27 |
| 14 | | 4% oxalic acid | 18 | 30 | 40 | | Nil | Nil |
| 15 | | | | | | | 70 | 15 |
| 16 | | | | | | | 70 | 18 |
| 17 | | | | | | | 70 | 45 |
| 18 | | | | | | | 100 | 6 |
| 19 | | | | | | | 100 | 19 |
| 20 | | | | | | | 100 | 24 |
| 21 | | 3% oxalic acid | 16 | 60 | 15 | Pressurized | 110 *1 | 4 |
| 22 | | | | | | steam | 180 *2 | 3 |
| 23 | | 3% oxalic acid + | 20 | 40 | 30 | | Nil | Nil |
| 24 | | 1% sulfuric acid | | | | Immersion | 80 | 10 |
| 25 | | | | | | in hot water | 80 | 11 |

| No. | Conversion of barrier layer into (pseudo) boehmite | Immersion test in phosphoric acid/ chromic acid | Chlorine gas corrosion test | Immersion test in hydrochloric acid |
|---|---|---|---|---|
| 1 | ○ | 7 | <1% | 460 minutes |
| 2 | ○ | 2 | <1% | 520 minutes |
| 3 | ○ | 3 | <1% | 480 minutes |
| 4 | ○ | 20 | <1% | 410 minutes |
| 5 | ○ | 1 | 5% | 400 minutes |
| 6 | ○ | 18 | <1% | 410 minutes |
| 7 | ○ | 2 | 5% | 440 minutes |
| 8 | ○ | 2 | 5% | 420 minutes |
| 9 | ○ | 49 | <1% | 350 minutes |
| 10 | ○ | 1 | 10% | 300 minutes |
| 11 | ○ | 90 | <1% | 310 minutes |
| 12 | ○ | 1 | 10% | 330 minutes |
| 13 | ○ | 1 | 10% | 320 minutes |
| 14 | X | 155 | <1% | 1 minute |
| 15 | ○ | 153 | <1% | 16 minutes |
| 16 | ○ | 116 | <1% | 280 minutes |
| 17 | ○ | 1 | 50% | 180 minutes |
| 18 | ○ | 120 | <1% | 48 minutes |
| 19 | ○ | 1 | 50% | 180 minutes |
| 20 | ○ | 1 | 70% | 10 minutes |
| 21 | ○ | 70 | <1% | 380 minutes |
| 22 | X | 20 | <1% | 10 minutes |
| 23 | X | 160 | <1% | 1 minute |
| 24 | ○ | 95 | 10% | 300 minutes |
| 25 | ○ | 54 | 30% | 200 minutes |

*1 1.2 atms.
*2 2 atms

TABLE 3

| No. | Substrate | Anodization treatment: Electrolytic solution | Treating temperature (° C.) | Electrolytic conditions (V) | Film thickness (μm) | Hydration treatment: Manner of hydration | Hydration temperature (° C.) | Hydration time (minutes) |
|---|---|---|---|---|---|---|---|---|
| 26 | K01 | 10% malonic acid + | 20 | 90 | 35 | Immersion | 90 | 8 |
| 27 | | 3% oxalic acid | | | | in hot water | | 10 |
| 28 | | | | | | | | 12 |

TABLE 3-continued

| | | | | | | | | |
|---|---|---|---|---|---|---|---|---|
| 29 | | | | | | | | 14 |
| 30 | | | | | | | | 16 |
| 31 | K02 | 4% oxalic acid | 18 | 30 | 40 | Immersion in hot water | 70 | 26 |
| 32 | A01 | | | | | | | |
| 33 | A02 | | | | | | | |
| 34 | A03 | | | | | | | |
| 35 | A04 | | | | | | | |
| 36 | A05 | | | | | | | |
| 37 | A06 | | | | | | | |
| 38 | A07 | | | | | | | |
| 39 | A08 | | | | | | | |
| 40 | A09 | | | | | | | |
| 41 | A10 | | | | | | | |
| 42 | A11 | | | | | | | |
| 43 | A12 | | | | | | | |
| 44 | A13 | | | | | | | |
| 45 | A14 | | | | | | | |
| 46 | B01 | | | | | | | |
| 47 | B02 | | | | | | | |
| 48 | B03 | | | | | | | |
| 49 | B04 | | | | | | | |
| 50 | B05 | | | | | | | |
| 51 | B06 | | | | | | | |
| 52 | B07 | | | | | | | |
| 53 | B08 | | | | | | | |
| 54 | B09 | | | | | | | |
| 55 | B10 | | | | | | | |

| No. | Conversion of barrier layer into (pseudo) boehmite | Immersion test in phosphoric acid/ chromic acid | Chlorine gas corrosion test | Immersion test in hydrochloric acid |
|---|---|---|---|---|
| 26 | ○ | 120 | <1% | 40 minutes |
| 27 | | 100 | <1% | 350 minutes |
| 28 | | 10 | <1% | >500 minutes |
| 29 | | 6 | 10% | 380 minutes |
| 30 | | 4 | 30% | 100 minutes |
| 31 | ○ | 2 | 15% | 200 minutes |
| 32 | | | <1% | 450 minutes |
| 33 | | | <1% | 410 minutes |
| 34 | | | <1% | >500 minutes |
| 35 | | | <1% | >500 minutes |
| 36 | | | <1% | 450 minutes |
| 37 | | | <1% | >500 minutes |
| 38 | | | <1% | 440 minutes |
| 39 | | | <1% | >500 minutes |
| 40 | | | 30% | 280 minutes |
| 41 | | | 20% | 250 minutes |
| 42 | | | 5% | 390 minutes |
| 43 | | | 5% | 350 minutes |
| 44 | | | 35% | 200 minutes |
| 45 | | | 10% | 320 minutes |
| 46 | | | <1% | 450 minutes |
| 47 | | | <1% | >500 minutes |
| 48 | | | <1% | 470 minutes |
| 49 | | | <1% | 430 minutes |
| 50 | | | 15% | 340 minutes |
| 51 | | | 40% | 120 minutes |
| 52 | | | 5% | 360 minutes |
| 53 | | | 30% | 250 minutes |
| 54 | | | 10% | 310 minutes |
| 55 | | | 5% | 390 minutes |

the barrier layer of the anodic oxide film is altered into boehmite and/or pseudo-boehmite, the dissolution rate of the film is at 100 mg/dm$^2$/15 minutes or below when determined by an immersion test in phosphoric acid/chromic acid (JIS H 8683-2) and a corroded area percent is at 10% or below after allowing to be exposed to an atmosphere of 5% $Cl_2$—Ar gas at 400° C. for 4 hours, the anodic oxide film is excellent in corrosion resistances. In this way, the invention can provide an Al alloy chamber member that is excellent in gas corrosion resistance, plasma resistance and corrosive solution resistance.

What is claimed is:

1. An Al alloy member having excellent corrosion resistance, which comprises an Al or Al alloy substrate having an anodic oxide film including a porous layer and a pore-free barrier layer, wherein at least a part of a structure of said barrier layer is altered into boehmite and/or pseudo-boehmite, a dissolution rate of said film is at 100 mg/dm$^2$/15 minutes or below when determined by an immersion test in phosphoric acid/chromic acid defined in JIS H 8683-2, and a corroded area percent is at 10% or below after allowing said film to stand in an atmosphere of 5% $Cl_2$—Ar gas at 400° C. for 4 hours.

2. An Al alloy member according to claim 1, wherein said Al alloy comprises 0.1 to 2.0 wt % of Si, 0.1 to 3.5 wt % of Mg, 0.1 to 1.5 wt % of Cu, or 1.0 to 1.5 wt % of Mn, 1.0 to 1.5 wt % of Cu, 0.7 to 1.0 wt % of Fe, with the balance being Al and inevitable impurities.

3. The use of the Al alloy member defined in claim 1 as a vacuum chamber member.

4. The use of the Al alloy member defined in claim 2 as a vacuum chamber member.

* * * * *